US011518567B2

(12) United States Patent
Solanki et al.

(10) Patent No.: US 11,518,567 B2
(45) Date of Patent: Dec. 6, 2022

(54) ROBOTIC LABELING SYSTEM AND METHOD OF LABELING PACKAGES

(71) Applicant: TE Connectivity Services GmbH, Schaffhausen (CH)

(72) Inventors: Swapnilsinh Solanki, Harrisburg, PA (US); Du Wen, Reading, PA (US); Hung Nguyen, Harrisburg, PA (US); Roberto Francisco-Yi Lu, Bellevue, WA (US); Tim Darr, York, PA (US); Xinping Deng, Lancaster, PA (US); Kevin Eshleman, Manheim, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 16/937,947

(22) Filed: Jul. 24, 2020

(65) Prior Publication Data

US 2022/0024628 A1 Jan. 27, 2022

(51) Int. Cl.

| | |
|---|---|
| ***B65C 9/26*** | (2006.01) |
| ***B65C 9/44*** | (2006.01) |
| ***B65C 9/40*** | (2006.01) |

(52) U.S. Cl.

CPC ..... *B65C 9/26* (2013.01); *B65C 9/44* (2013.01); *B65C 2009/401* (2013.01); *B65C 2009/408* (2013.01)

(58) Field of Classification Search

CPC .. B65C 1/021; B65C 9/02; B65C 9/04; B65C 9/06; B65C 9/26; B65C 9/40; B65C 9/44; B65C 9/46; B65C 2009/401; B65C 2009/407; B65C 2009/408

See application file for complete search history.

(56) References Cited

U.S. PATENT DOCUMENTS

| | | | | |
|---|---|---|---|---|
| 2013/0174960 | A1* | 7/2013 | Goetz | B65C 3/00 156/64 |
| 2014/0096900 | A1* | 4/2014 | Wojdyla | B65C 9/02 156/247 |
| 2014/0104626 | A1* | 4/2014 | Giordano | G09F 3/0288 358/1.6 |
| 2016/0052659 | A1* | 2/2016 | Bowers | B65C 1/021 156/64 |
| 2016/0063770 | A1* | 3/2016 | Bowers | B07C 3/14 156/64 |
| 2018/0221244 | A1* | 8/2018 | Joplin | B65B 61/20 |
| 2018/0265239 | A1* | 9/2018 | Riva | B65C 1/021 |

* cited by examiner

*Primary Examiner* — George R Koch

(57) ABSTRACT

A robotic labeling system includes a package locating system for locating a package at a labeling station and a package identification system having a scanning device configured to scan an identification tag on the package to identify the package. The package identification system has a package measurement module configured to determine at least one dimension of the package and a package orientation module configured to determine an orientation of the package in the labeling station. The robotic labeling system includes a label application system including a label printer printing a label for the package based on an identity of the package determined by the scanning device and a label applicator operated to apply the label based on a measurement input from the package measurement module and based on an orientation input from the package orientation module.

21 Claims, 3 Drawing Sheets

ROBOTIC LABELING SYSTEM AND METHOD OF LABELING PACKAGES

BACKGROUND OF THE INVENTION

The subject matter herein relates generally to package labeling systems and methods.

Package labeling is a manual process at many warehouses and distribution centers. The manual labeling process relies on operators to determine the location where the labels need to be applied. Manual labeling processes have high labor costs, are subject to human error, and are time consuming to apply the labels. Additionally, labels applied manually to packages may be at improper or unwanted positions and may be applied inconsistently from package to package. Some known automated labeling systems are in use in warehouses and distribution centers. However, conventional labeling systems use simple labeling methods to apply the labels to the packages. For example, the conventional labeling systems use a single axis arm attached to a printer to apply the label to the box. The label is always applied to the same side of the box. The box is required to have a particular orientation relative to the printer and the label applicator. Known automated labeling systems do not tend to accommodate different sized packages.

A need remains for a dynamic, automated labeling system for labeling packages.

BRIEF DESCRIPTION OF THE INVENTION

In one embodiment, a robotic labeling system is provided. The robotic labeling system includes a package locating system for locating a package at a labeling station. The robotic labeling system includes a package identification system having a scanning device configured to scan an identification tag on the package to identify the package. The package identification system has a package measurement module configured to determine at least one dimension of the package. The package identification system has a package orientation module configured to determine an orientation of the package in the labeling station. The robotic labeling system includes a label application system including a label printer and a label applicator. The label printer prints at least one label for the package based on an identity of the package determined by the scanning device. The label applicator is operated to apply at least one label to the package based on a measurement input from the package measurement module and based on an orientation input from the package orientation module.

In another embodiment, a robotic labeling system is provided. The robotic labeling system includes a package locating system for locating a package at a labeling station. The robotic labeling system includes a package identification system having a scanning device configured to scan an identification tag on the package to identify the package. The robotic labeling system includes a label application system including a label printer and a label applicator. The label printer prints at least one label for the package based on an identity of the package determined by the scanning device. The label applicator is operated to apply at least one label to the package. The label application system has a label verification scanning device configured to scan the at least one label applied to the package to verify proper application of the at least one label.

In a further embodiment, a method of labeling a package is provided. The method locates the package in a labeling station and scans an identification tag on the package using a scanning device to identify the package. The method prints a label for the package at a label printer. The printed label is based on an identity of the package determined by the scanning device. The method applies the label using a label applicator and scans the label applied to the package using a label verification scanning device to verify proper application of the label.

DETAILED DESCRIPTION OF THE INVENTION

Figure 1:
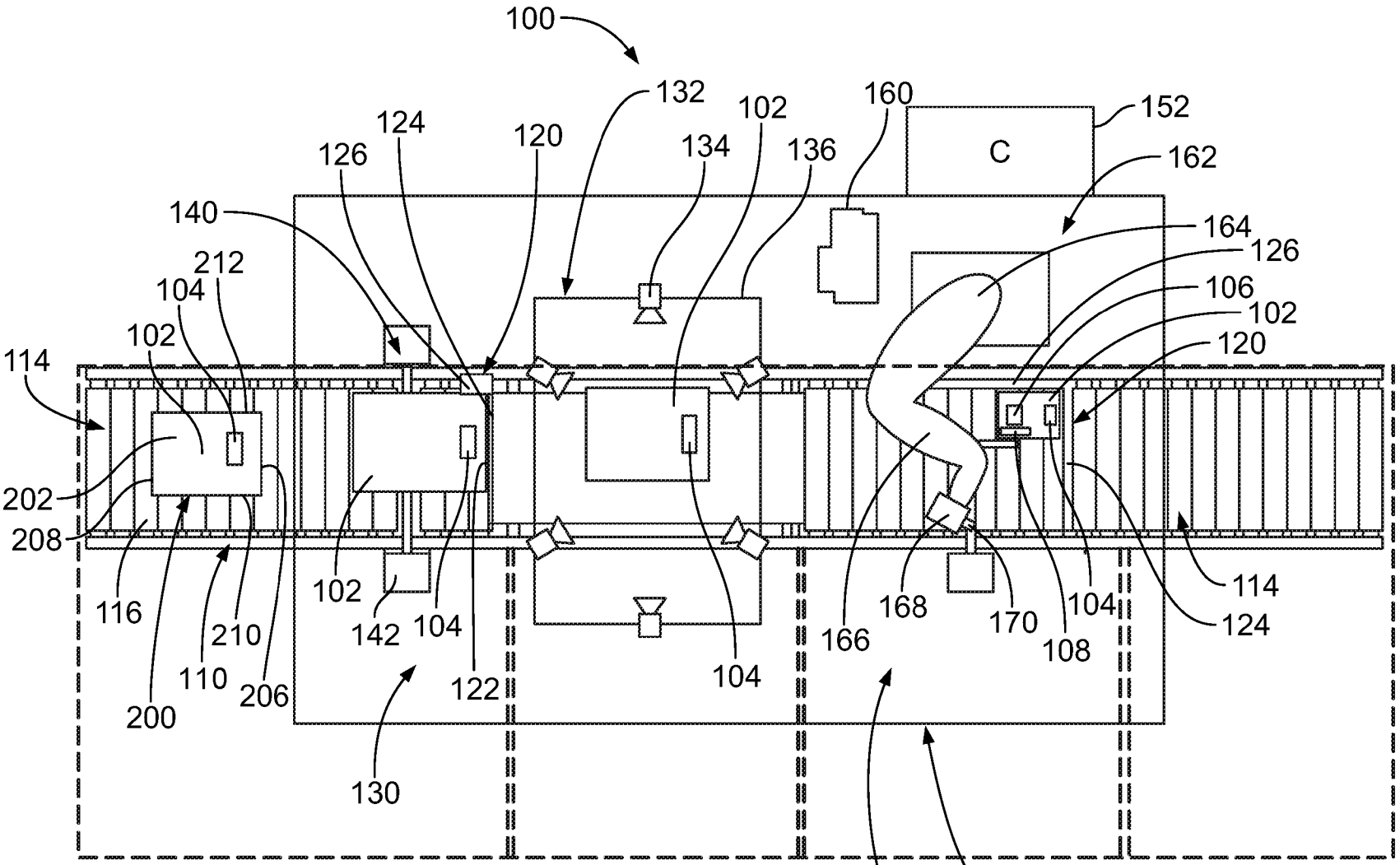
FIG. 1 illustrates a robotic labeling system in accordance with an exemplary embodiment.

FIG. 1 illustrates a robotic labeling system 100 in accordance with an exemplary embodiment. The robotic labeling system 100 is an automated system used for labeling packages 102. In an exemplary embodiment, the robotic labeling system 100 utilizes one or more multiple robots for applying one or more labels on the packages 102. The robotic labeling system 100 uses intelligent control algorithms to apply the label(s). The robotic labeling system 100 scans the labels after application to verify proper application of the label(s) to the package 102 before sending the package to another processing station.

The robotic labeling system 100 includes a package locating system 110 for locating the package 102 in a labeling station 112. Optionally, multiple labeling stations may be provided and the package locating system 110 is used to locate packages at the various labeling stations. The robotic labeling system 100 includes a package identification system 130 for identifying the package 102 in the labeling station 112. The robotic labeling system 100 includes a label application system 150 for applying labels to the package 102. In various embodiments, the label application system 150 may apply multiple labels to each package 102, such as to various sides 200 of the package 102.

The package 102 may be a box, such as a cardboard box, or other type of container. In various embodiments, the package 102 may be parallelepiped having six sides 200, including a top side 202, a bottom side (not shown, but located opposite the top side 202), a front side 206, a rear side 208, a right side 210, and a left side 212. The package 102 may include additional sides 200 in alternative embodiments. The package 102 may have other shapes in alternative embodiments. In various embodiments, the sides 200 may be flat or planar. Alternatively, one or more of the sides 200 may be curved. In an exemplary embodiment, the sides 200 meet at corners and have edges extending between the corners. In various embodiments, one or more the sides 200 may be defined by panels meeting at seams. The panels may be taped at the seams. In various embodiments, the label application system 150 may avoid applying the labels at the seams (for example, avoid applying the labels over the tape).

In an exemplary embodiment, the package 102 includes an identification tag 104 at one of the sides 200. For example, the identification tag 104 may be a label applied to one of the sides 200. Alternatively, the identification tag 104 may be printed directly on one of the sides 200. The identification tag 104 is used to identify the particular package 102 (for example, compared to other packages 102). The identification tag 104 may be a unique identifier for the package 102. Information about the package 102 may be associated with the identification tag 104, such as data contained in a warehouse management system (WMS), and stored as identifying data. The identifying data about the package 102 may include content information relating to the contents of the package. The identifying data about the package 102 may include dimensional information relating to the height, width and length of the package. The identifying data may include shipping information relating to the package 102. In various embodiments, the identification tag 104 is a scannable tag, such as a barcode, a data matrix, a QR code, or another type of symbolic scan code. The identification tag 104 may be used to track the package 102 within a warehouse management system. In various embodiments, the identification tag 104 is applied to the package 102 outside of the labeling station 112. For example, the identification tag 104 may be applied to the package 102 prior to the package 102 being transported to the labeling station 112. The identification tag 104 may be applied to the package 102 when the package 102 is formed or when the package 102 is filled, such as at a packing station upstream of the labeling station 112. Alternatively, the identification tag 104 may be applied by the label application system 150 at the labeling station 112. The identification tag 104 may be applied to any of the sides 200. In various embodiments, the identification tag 104 may be on any of the sides 200 other than the bottom side 204. In various embodiments, multiple identification tags 104 may be provided, such as on two opposite sides (for example, to avoid having the identification tag 104 on the bottom side 204, and thus unviewable, as the package 102 is presented to the labeling station 112).

In an exemplary embodiment, the package 102 receives a shipping label 106. The shipping label 106 contains information about where the package 102 is being shipped. The shipping label 106 may include a name, an address, or other identifying data. In various embodiments, the shipping label 106 may include symbolic scan codes used for shipping. The shipping label 106 is applied to the package 102 by the label application system 150 at the labeling station 112. The shipping label 106 may be applied to any of the sides 200 other than the bottom side 204. In various embodiments, the shipping label 106 may be applied to any of the sides 200 other than the side including the identification tag 104. In various embodiments, the label application system 150 does not apply any other labels to the side 200 that receives the shipping label 106.

In an exemplary embodiment, the package 102 receives one or more customer specified labels 108. The customer specified label 108 may contain information about the contents of the package 102 or other information. For example, the customer specified label 108 may contain information about the shipper of the package 102, the location of where the package 102 is being shipped from, return shipping information, warning labels regarding the package 102 or the content of the package 102, and the like. In various embodiments, the customer specified label 108 may include symbolic scan codes having data relating to the content of the package 102 or other information. The customer specified label 108 is applied to the package 102 by the label application system 150 at the labeling station 112. The customer specified label 108 may be applied to any of the sides 200 other than the bottom side 204. In various embodiments, the customer specified label 108 may be applied to any of the sides 200 other than the side including the identification tag 104. In various embodiments, the label application system 150 does not apply any other labels to the side 200 that receives the customer specified label 108. For example, the shipping label 106 is applied to a different side 200 than the customer specified label 108. Other types of labels may be applied to the package 102 in alternative embodiments.

In an exemplary embodiment, the package locating system 110 includes a transportation device 114 for moving the package 102 to the labeling station 112. In the illustrated embodiment, the transportation device 114 includes a conveyor 116. The conveyor 116 moves the package to the package identification system 130 and/or moves the package 102 to the label application system 150 and/or moves the package 102 away from the labeling station 112, such as to a sorting station or other processing station such as a robotic palletizer. Other types of transportation devices 114 may be used in alternative embodiments. The package locating system 110 includes one or more indexing devices 120 having datum surfaces 122 for locating the package 102 in the labeling station 112. In the illustrated embodiment, multiple indexing devices 120 are provided for positioning the packages 102 at different positions within the labeling station 112. The indexing device 120 may include a stop gate 124 used to stop the package 102 on the conveyor 116. The stop gate 124 controls a front-to-rear position of the package 102 in the labeling station 112. The indexing device 120 may include a side rail 126 for controlling a side-to-side position of the package 102 in the labeling station 112. In various embodiments, the stop gate 124 and the side rail 126 may position the package 102 at a datum position for measuring the package. In various embodiments, the stop gate 124 and the side rail 126 may position the package 102 at a datum position for scanning the package, such as for identifying the package 102, such as for scanning the identification tag 104. In various embodiments, the stop gate 124 and the side rail 126 may position the package 102 at a datum position for applying the label(s) to the package 102. When the package 102 engages the stop gate 124 and the side rail 126, the location of the package 102 is known by the robotic labeling system 100 for applying the labels to the package 102. Other types of indexing devices may be used in alternative embodiments.

In an exemplary embodiment, the package identification system 130 includes a scanning device 132 for identifying the package 102. In various embodiments, the scanning device 132 may include one or more cameras 134. The cameras 134 may be mounted to a frame 136. The frame 136 may be movable to control positioning of the camera(s) 134. In an exemplary embodiment, the cameras 134 are configured to view multiple sides 200 of the package 102. The scanning device 132 allows for vision inspection of the package 102. The scanning device 132 identifies an orientation of the package 102 in the labeling station 112. The label application system 150 is controlled based on the orientation of the package 102. The orientation of the package 102 in the labeling station 112 may be based on the location of the identification tag 104 (for example, the side 200 having the identification tag 104). For example, the scanning device 132 scans the package 102 to identify the particular side 200 having the identification tag 104. For example, the scanning device 132 may identify the top side 202 as having the identification tag 104 (top-side orientation); may identify the front side 206 is having the identification tag 104 (front-side orientation); may identify the rear side 208 as having the identification tag 104 (rear-side orientation); may identify the right side 210 as having the identification tag 104 (right-side orientation); or may identify the left side 212 as having the identification tag 104 (left-side orientation). The operation of the label application system 150 is controlled based on which side 200 has the identification tag 104. For example, the label application system 150 may determine appropriate sides 200 to apply the shipping label 106 and the customer specified label 108 based upon which side 200 has the identification tag 104.

In an exemplary embodiment, the package identification system 130 identifies a size of the package 102 and a shape of the package 102. In various embodiments, the scanning device 132 may be used to identify the size and the shape of the package 102. For example, the scanning device 132 may be used to scan the identification tag 104 and determine the size and shape of the package 102 based on data from the identification tag 104 (for example, data in the warehouse management system). In other various embodiments, the cameras may be used to image the package 102 and the package identification system 130 may determine the size and the shape of the package 102 based on the image. For example, the package identification system 130 may identify the number of sides 200, the number of corners, the number of edges, the number of seams, the location of the seams, and the like based on pattern or boundary recognition. The package identification system 130 may identify a height of the package 102 and/or a width of the package 102 and/or a length of the package 102 from analysis of the image. The package identification system 130 includes a package measurement module 140 configured to determine at least one dimension of the package 102. The package measurement module 140 may include software to analyze the image data to determine the height and/or the width and/or the length of the package 102. The package measurement module 140 may include a communication element for retrieving package dimensions from the warehouse management system. In other various embodiments, the package identification system 130 includes one or more sensors 142 for measuring one or more dimensions of the package 102. The sensors 142 sense dimensions of the package 102 with reference to the datum of the indexing device 120. The package measurement module 140 receives inputs from the sensors 142 to determine the dimensions of the package 102. The size dimensions of the package 102 are used to control the label application system 150. For example, the label application system 150 may use the size dimensions to determine relevant labeling locations on the package 102. In an exemplary embodiment, the robotic labeling system 100 is capable of receiving different sized and shaped packages 102 and is capable of labeling such packages 102 by automatically determining the size and shape of the particular package 102 at the labeling station 112.

The label application system 150 is used to apply the labels to one or more of the sides 200 of the package 102. In an exemplary embodiment, the label application system 150 includes a label printer 160 configured to print corresponding labels for the package 102. The label application system 150 includes a label applicator 162 configured to transfer the labels from the label printer 160 to the package 102. The label applicator 162 is used to apply the labels to the package 102. For example, the label applicator 162 may press the labels onto the sides 200 of the packages 102. In various embodiments, the label application system 150 may include multiple label printers 160 and/or multiple label applicators 162 for applying the labels.

In an exemplary embodiment, the label application system 150 includes a controller 152 that controls operation of the label application system 150. The controller 152 is operably coupled to the label printer 160 and the label applicator 162. The controller 152 receives inputs from the package locating system 110 and the package identification system 130 to determine a labeling scheme for labeling the package 102. The controller 152 determines which label to print, such as the shipping label 106, the customer specified label 108 or another type of label. The controller 152 controls operation of the label printer 160. The controller 152 controls the information printed on the label. The controller 152 controls operation of the label applicator 162 based on the orientation of the package 102. For example, the controller 152 controls which side 200 the label applicator 162 applies the label to based on the side 200 having the identification tag 104. The controller 152 controls operation of the label applicator 162 based on the size and shape of the package 102 determined by the package identification system 130. For example, the controller 152 determines appropriate labeling locations relative to the datum surface 122, based on the size and shape of the package 102, and controls movements of the label applicator 162 to move to such labeling locations.

Figure 2:
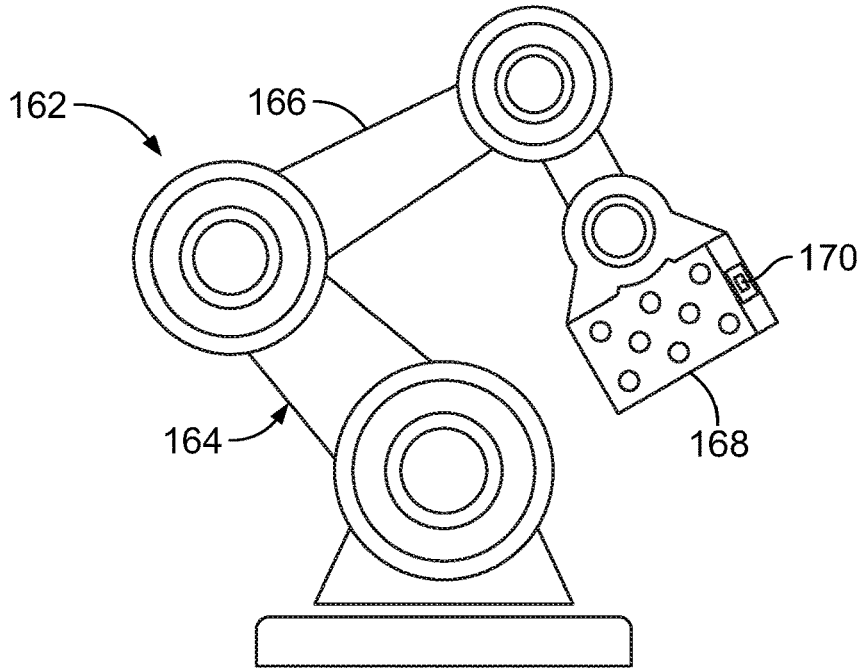
FIG. 2 illustrates the label applicator in accordance with an exemplary embodiment.

With reference to FIG. 2, which illustrates the label applicator 162 in accordance with an exemplary embodiment, the label applicator 162 includes a multi-axis robot 164 having an articulating arm 166 that moves between the label printer 160 and the package 102. An end effector 168 is provided at the end of the arm 166 to pick up the label from the label printer 160 and to apply the label to the side 200 of the package 102. In various embodiments, the end effector 168 may be a vacuum end effector using suction to hold the label on the end effector 168. Other types of end effectors may be used in alternative embodiments. The arm 166 is movable in three-dimensional space to apply labels to the top side 202 and/or the front side 206 and/or the rear side 208 and/or the right side 210 and/or the left side 212 of the package 102. The label applicator 162 is capable of applying multiple different labels on different sides of the package. The label applicator 162 is capable of applying labels to different sized boxes.

In an exemplary embodiment, the label application system 150 includes a label verification scanning device 170 configured to scan the labels applied to the package 102 to verify proper application of the labels. The label verification scanning device 170 allows for vision inspection and verification of the labels. For example, the label verification scanning device 170 may verify that the label has been applied. The label verification scanning device 170 may verify that the label is on the proper side 200 of the package 102. The label verification scanning device 170 may verify that the label is in the proper location on the package 102. The label verification scanning device 170 may verify that the label has the appropriate information printed on the label. The label verification scanning device 170 may verify that the information printed is legible and/or scannable. The label verification scanning device 170 may verify that the label is applied correctly and without wrinkles. If the label verification scanning device 170 determines the applied label is defective, the package 102 may be rejected. However, if the label verification scanning device 170 verifies that the label is properly applied to the package 102, the package 102 may be transferred downstream to the next processing station, such as a package sorting station. In various embodiments, the label verification scanning device 170 may be coupled to the arm 166 and movable with the arm 166. As such, the label verification scanning device 170 is movable to view various sides of the package 102.

Alternatively, the label verification scanning device 170 may be separate from the arm, such as including cameras mounted around the labeling station 112 to view the different sides of the package 102. The label verification scanning device 170 may scan the label immediately after the label is applied, such as prior to the arm 166 moving away from the application area. The label verification scanning device 170 may include a camera configured to image the label.

Figure 3:
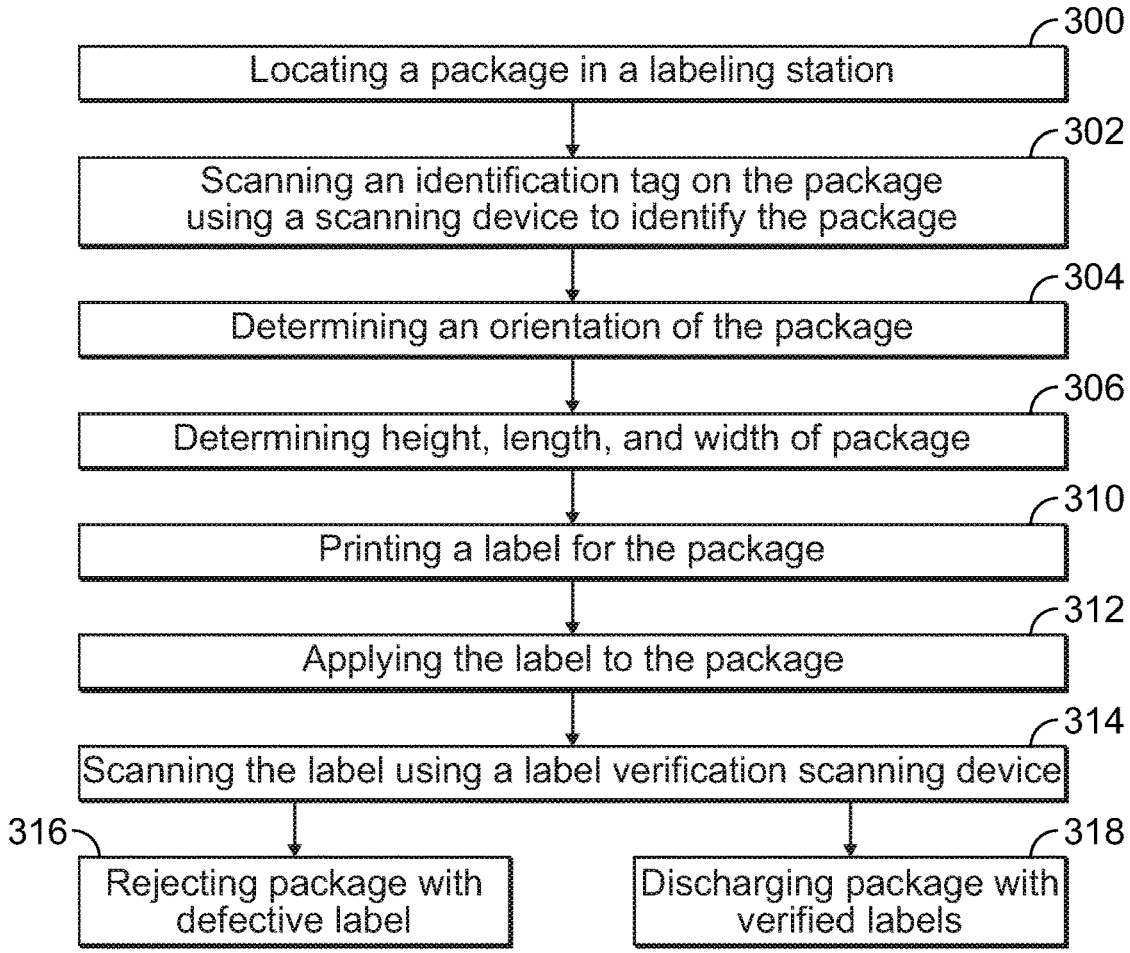
FIG. 3 is a flowchart of a method of labeling a package in accordance with an exemplary embodiment.

FIG. 3 is a flowchart of a method of labeling a package in accordance with an exemplary embodiment. The method may be used by a controller of a label application system to determine an appropriate labeling scheme for the particular package. The controller includes logic configured to determine an appropriate labeling scheme based on the package orientation. The labeling scheme is based on the size of the package, the shape of the package, the number of labels that need to be applied to the package, relative locations of the labels (for example, same sides, different sides, adjacent sides, opposite sides, and the like). The labeling scheme developed using the method may be based on which side of the package has the identification tag as presented in the labeling station.

The method includes locating 300 the package in a labeling station. For example, the package may be transported to the labeling station by a conveyor or other transportation device. The package may be located by an indexing device, such as a stop gate a side rail or another positioning device. The package may be positioned by engaging one or more datum surfaces to locate the package in the labeling station. By locating the package at a particular location (for example, at the datum surface), the labels may be accurately applied.

The method includes scanning 302 an identification tag on the package using a scanning device to identify the package. The identification tag may be scanned using one or more cameras. The method optionally includes the step of determining 304 an orientation of the package based on the scanning of the identification tag by the scanning device. For example, the scanning device may be used to determine which side includes the identification tag. The orientation may be used to determine to which side(s) the label(s) should be applied. The identification tag may be scanned to determine information about the package, such as the contents of the package, shipping information for the package, dimensions of the package, and the like. The method optionally includes the step of determining 306 a height, a length and a width of the package based on the scanning of the identification tag by the scanning device. For example, the scanning device may be used to determine the height, the length and the width based on images of the package from the cameras. The size and shape of the package is determined for proper label application. For example, the various sides are located relative to the datum surface and thus the label application robot may be controlled to label the package based on the size and shape of the package. The controller is configured to determine the size based on inputs from the scanning device. As such, the labeling scheme may be controlled automatically without user input based on signals or inputs from the scanning device. Application of other labels is controlled based on the orientation of the package in the labeling station. For example, the other labels may be applied to other sides based on which side of the package having the identification tag. The controller is configured to determine the orientation based on inputs from the scanning device. As such, the labeling scheme may be controlled automatically without user input based on signals or inputs from the scanning device.

The method includes printing 310 a label for the package at a label printer, the printed label being based on an identity of the package determined by the scanning device. For example, the label printer may be used to print a shipping label based on shipping information associated with the identity of the package. For example, the shipping information may be contained in a warehouse management system retrieved based on scanning the identification tag. The label printer may be used to print a customer specific label for the package. The customer specific label may include information relating to the contents of the package or other information. For example, the customer specified label may contain information about the shipper of the package, the location of where the package is being shipped from, return shipping information, warning labels regarding the package or the content of the package, and the like.

The method includes applying 312 the label to the package using a label applicator. The label applicator picks up the label from the label printer. For example, the end effector picks up the label, such as using a suction plate. The label applicator transfers the label from the label printer to the package. At the package, the label applicator may press the label onto the side of the package. Optionally, the operation of the label applicator may be controlled based on the orientation of the package. For example, the side of the package that receives the label may be based on the orientation of the package (for example, the side of the package having the identification label). Optionally, the operation of the label applicator may be controlled based on the determined height, length and width dimensions of the package. For example, the amount of movement in three dimensional space of the arm of the label applicator may be determined based on the size and shape of the package.

The method includes scanning 314 the label applied to the package using a label verification scanning device to verify proper application of the label. For example, the label verification scanning device may verify that the label has been applied and is on the proper side of the package and/or in the proper location on the package. The label verification scanning device may verify that the label has the appropriate information printed on the label and that the information printed is legible and/or scannable. The label verification scanning device may verify that the label is applied correctly and without wrinkles. The label verification scanning device 170 may include a camera configured to image the label. In various embodiments, the label verification scanning device may be coupled to the label applicator and movable with the label applicator to scan the label immediately after the label is applied, such as prior to the label applicator moving away from the application area.

The method includes rejecting 316 the package if the label verification scanning device determines the applied label is defective. For example, the package may be removed from the labeling station and either discarded or moved to a station for reworking the package (for example, removing the defective label).

The method includes discharging 318 the package from the labeling station if the label verification scanning device verifies that the label is properly applied to the package 102. The package may be transferred downstream, such as by the conveyor, to the next processing station, such as a package sorting station.

Figure 4:
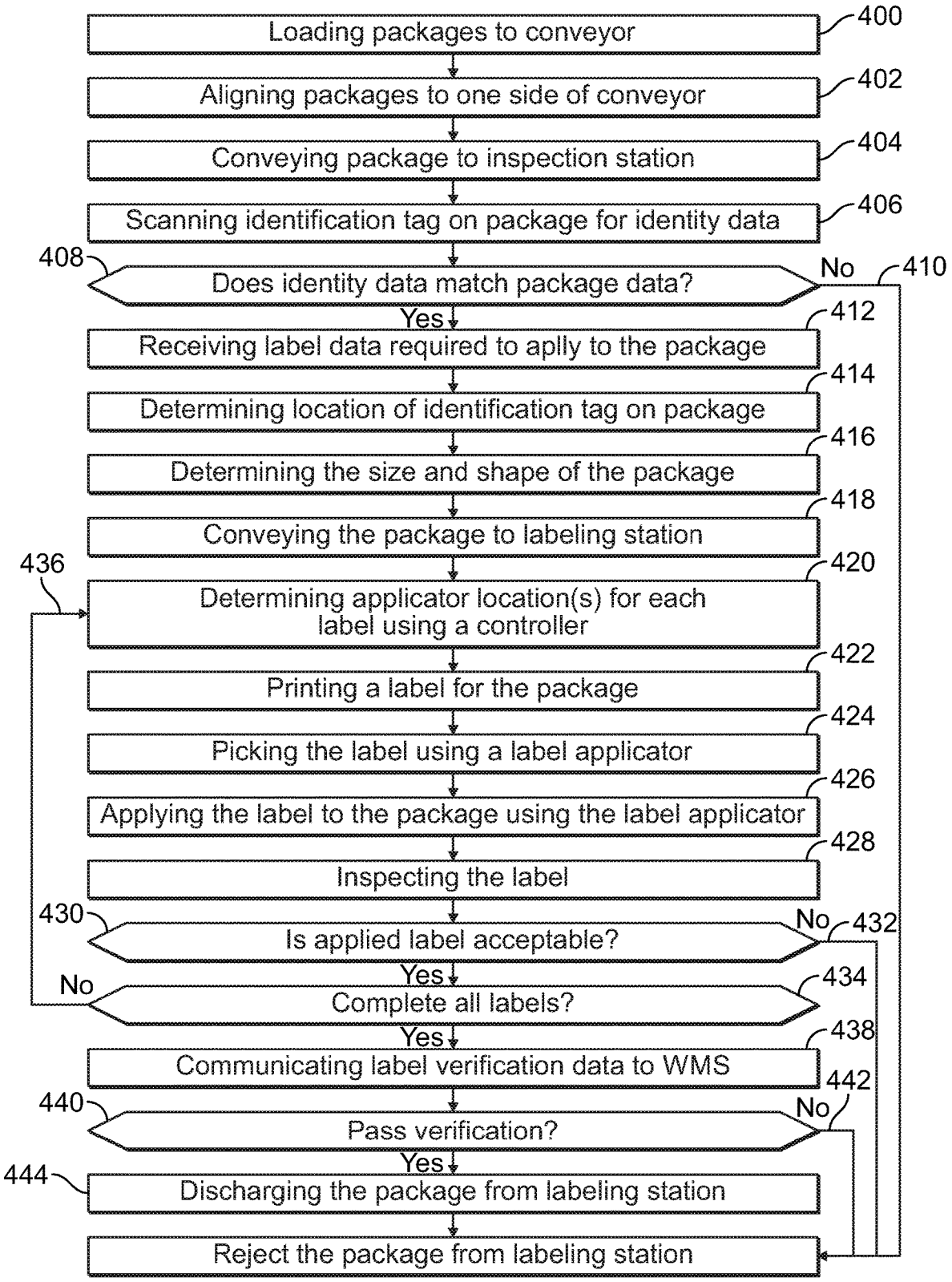
FIG. 4 is a flowchart of a method of labeling a package in accordance with an exemplary embodiment.

FIG. 4 is a flowchart of a method of labeling a package in accordance with an exemplary embodiment. The steps are in an exemplary method of labeling a package. Various steps may be omitted in the order of the steps may be altered in various alternative embodiments. The method may be used by a controller of a label application system to determine an appropriate labeling scheme for the particular package. The controller includes logic configured to determine an appropriate labeling scheme based on the package orientation. The labeling scheme is based on the size of the package, the shape of the package, the number of labels that need to be applied to the package, relative locations of the labels (for example, same sides, different sides, adjacent sides, opposite sides, and the like). The labeling scheme developed using the method may be based on which side of the package has the identification tag as presented in the labeling station.

The method includes loading 400 packages onto a conveyor and aligning 402 the packages to one side of the conveyor. The method includes conveying 404 the package to an inspection station and scanning 406 an identification tag on the package for identity data relating to the package. The identification tag may include a symbolic scan code, such as a barcode or QR code. The identity data may be communicated with a warehouse management system (WMS).

The method includes determining 408 if the identity data matches package data in the warehouse management system. For example, the controller is configured to compare the scanned data with the data in the database of the WMS. If the identity data does not match any package data in the warehouse management system, the package is rejected 410 from the labeling station. As such, the labeling system operating the method is able to automatically reject packages, which may be further processed if desired.

If the identity data matches package data in the warehouse system the method proceeds to the step of receiving 412 label data required to apply on the package from the warehouse management system. The method includes determining 414 a location of the identification tag on the package. The location of the identification tag may be determined by a scanning device, such as a camera, scanning the package. The method includes determining 416 a size and a shape of the package (for example, determining a height, a width, and a length of the package). The size and the shape of the package may be determined by a scanning device, such as a camera, scanning the package. The size of the shape of the package may be determined by sensors or other measuring devices at the inspection station. The size and shape of the package is determined for proper label application. For example, the various sides are located relative to the datum surface and thus the label application robot may be controlled to label the package based on the size and shape of the package. The controller is configured to determine the size based on inputs from the scanning device. As such, the labeling scheme may be controlled automatically without user input based on signals or inputs from the scanning device. Application of other labels is controlled based on the orientation of the package in the labeling station. For example, the other labels may be applied to other sides based on which side of the package having the identification tag. The controller is configured to determine the orientation based on inputs from the scanning device. As such, the labeling scheme may be controlled automatically without user input based on signals or inputs from the scanning device.

The method includes conveying 418 the package to a labeling station. The package may be conveyed using a conveyor. The package may be positioned at a predetermined location within the labeling station, such as using an indexing device. The method includes determining 420 application locations for each label using a controller. The controller may use artificial intelligence to determine the application locations. The controller may determine application locations based on the orientation of the package, such as the location of the identification tag. The controller may determine application locations based on the size and shape of the package. The method includes printing 422 the labels for the package. The method includes picking 424 the labels from the label printer using a label applicator. The method includes applying 426 the labels using the label applicator.

The method includes inspecting 428 the labels after the labels are applied. The labels may be inspected using a label verification scanning device. The label verification scanning device may scan the label, such as scanning a symbolic scan code (for example, barcode or QR code) on the label. The method includes a verification step of determining 430 if the applied label is acceptable. If the applied label is not acceptable (for example, the label cannot be properly scanned, the label is in an improper location, the label is missing, and the like), the package is rejected 432 from the labeling station. As such, the system operating the method may automatically reject packages determined to be defective to ensure that the packages do not continue downstream to other processing stations. The automated control system is controlled without operator intervention to speed up the package processing and reduce labor costs. If the applied label is acceptable, the method includes determining 434 if all of the labels have been applied to the package. At 436, if all of the labels have not been applied, the method returns to step 420 to determine application locations for the next label.

If all of the labels have been applied, the method includes communicating 438 label verification data to the warehouse management system (WMS). The method further includes determining 440 if the package labeling passes verification. If the package labeling does not passes verification, the package is rejected 442 from the labeling station. If the package labeling passes verification, the method includes discharging 444 the package from the labeling station for further processing. For example, the conveyor may discharge the package to a sorting station for further processing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A robotic labeling system comprising:

a package locating system for locating a package at a labeling station;

a package identification system having a scanning device configured to scan an identification tag on the package to identify the package, the package identification system having a package measurement module configured to determine at least one dimension of the package, the package identification system having a package orientation module configured to determine an orientation of the package in the labeling station from a plurality of possible orientations based on the scan and generating an orientation input based on the determined orientation; and a label application system including a label printer and a label applicator, the label printer printing at least one label for the package based on an identity of the package determined by the scanning device, the label applicator operated to apply the at least one label to the package based on a measurement input from the package measurement module and based on the orientation input from the package orientation module, the label application system including a label verification scanning device configured to scan the at least one label applied to the package to verify proper application of the at least one label prior to moving the package out of the labeling station.

2. The robotic labeling system of claim 1, wherein the label verification scanning device is provided at an end of the label applicator to scan the at least one label immediately after being applied to the package.

3. The robotic labeling system of claim 1, wherein the package orientation module uses the scan of the identification tag by the scanning device to determine the orientation of the package.

4. The robotic labeling system of claim 1, wherein the package orientation module determines which side of the package contains the identification tag, the label applicator being operated to apply the at least one label to a different side of the package than the side having the identification tag.

5. The robotic labeling system of claim 1, wherein the package measurement module uses the scan of the identification tag by the scanning device to determine the at least one dimension of the package.

6. The robotic labeling system of claim 1, wherein the package measurement module determines a height, a width, and a length of the package, the label application system using the height, the width and the length dimensions to control the label applicator and apply the at least one label.

7. The robotic labeling system of claim 1, wherein the package identification system includes a sensor to measure the package, the package measurement module receiving inputs from the sensor to determine the at least one dimension of the package.

8. The robotic labeling system of claim 1, wherein the package locating system includes an indexing device to position the package at a datum, the package measurement module determining the at least one dimension with reference to the datum.

9. The robotic labeling system of claim 1, wherein the scanning device includes a plurality of cameras configured to scan multiple sides of the package.

10. The robotic labeling system of claim 1, wherein the package locating system includes a conveyor moving the package.

11. The robotic labeling system of claim 1, wherein the label applicator includes a multi-axis robot having an arm movable in three-dimensional space and an end effector coupled to the arm configured to transport the label from the label printer to the package.

12. The robotic labeling system of claim 11, wherein the label verification scanning device is coupled to the arm and configured to scan the at least one label applied to the package to verify proper application of the at least one label.

13. The robotic labeling system of claim 1, wherein the package locating system moves the package out of the labeling station after the label is scanned, the package being moved to different locations when the label verification scanning device determines if the label passes or fails the scan by the label verification scanning device.

14. A robotic labeling system comprising:

a package locating system for locating a package at a labeling station;

a package identification system having a scanning device configured to scan an identification tag on the package to identify the package to determine an orientation of the package in the labeling station from a plurality of possible orientations; and a label application system including a label printer and a label applicator, the label printer printing at least one label for the package based on an identity of the package determined by the scanning device, the label applicator operated to apply the at least one label to the package based on the orientation of the package determined by the scanning device, the label application system having a label verification scanning device configured to scan the at least one label applied to the package to verify proper application of the at least one label prior to moving the package out of the labeling station.

15. The robotic labeling system of claim 14, wherein the label applicator includes a multi-axis robot having an arm movable in three-dimensional space and an end effector coupled to the arm configured to transport the at least one label from the label printer to the package, the label verification scanning device being coupled to the arm and movable with the arm to scan the at least one label.

16. The robotic labeling system of claim 14, wherein the package identification system includes a package orientation module configured to determine an orientation of the package in the labeling station, the label applicator being controlled based on the orientation of the package in the labeling station.

17. The robotic labeling system of claim 14, wherein the package identification system includes a package measurement module configured to determine at least one dimension of the package, the label applicator being controlled based on a measurement input from the package measurement module.

18. A method of labeling a package comprising:

locating the package in a labeling station;

scanning an identification tag on the package using a scanning device to identify the package and identify an orientation of the package in the labeling system from a plurality of possible orientations;

printing a label for the package at a label printer, the printed label being based on an identity of the package determined by the scanning device;

applying the label using a label applicator based on the orientation of the package in the labeling station; and scanning the label applied to the package using a label verification scanning device to verify proper application of the label prior to moving the package out of the labeling station.

19. The method of claim 18, further comprising rejecting the package if the label verification scanning device determines the applied label is defective.

20. The method of claim 18, further comprising determining an orientation of the package based on the scanning of the identification tag by the scanning device, said applying the label using the label applicator comprises controlling operation of the label application based on the orientation of the package.

21. The method of claim 18, further comprising determining a height, a length and a width of the package, said applying the label using the label applicator comprises controlling operation of the label application based on the determined height, length and width dimensions of the package.

* * * * *